US006501913B2

(12) United States Patent
Hattori et al.

(10) Patent No.: US 6,501,913 B2
(45) Date of Patent: Dec. 31, 2002

(54) CONTAINER, ITS SUPPORT STRUCTURE, AND IMAGE FORMATION APPARATUS

(75) Inventors: Yoshio Hattori, Ohta-ku (JP); Tomotoshi Nakahara, Ohta-ku (JP); Takaaki Yanagisawa, Ohta-ku (JP); Kazuhisa Sudo, Ohta-ku (JP); Kouta Fujimori, Ohta-ku (JP); Masumi Sato, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/940,446

(22) Filed: Aug. 29, 2001

(65) Prior Publication Data

US 2002/0031375 A1 Mar. 14, 2002

(30) Foreign Application Priority Data

Aug. 31, 2000 (JP) ..... 2000-263387

(51) Int. Cl.[7] ..... G03G 15/00; G03G 15/08

(52) U.S. Cl. ..... 399/12; 399/262

(58) Field of Search ..... 399/12, 262, 258, 399/119, 120; 141/297; 222/DIG. 1

(56) References Cited

U.S. PATENT DOCUMENTS

| | | | | |
|---|---|---|---|---|
| 4,607,939 A | | 8/1986 | Saito | 399/19 |
| 4,740,808 A | | 4/1988 | Kasamura et al. | 399/12 |
| 5,245,385 A | | 9/1993 | Fukumizu et al. | 399/91 |
| 5,289,147 A | | 2/1994 | Koike et al. | 399/1 |
| 5,367,363 A | | 11/1994 | Kai et al. | 399/113 |
| 5,400,123 A | | 3/1995 | Sato et al. | 399/187 |
| 5,630,195 A | | 5/1997 | Sawayama et al. | 399/49 |
| 5,761,570 A | | 6/1998 | Sawayama et al. | 399/49 |
| 5,860,038 A | | 1/1999 | Kato et al. | 399/49 |
| RE36,301 E | | 9/1999 | Kai et al. | 399/113 |
| 6,032,010 A | * | 2/2000 | Kim et al. | 399/12 X |
| 6,055,386 A | | 4/2000 | Kato et al. | 399/49 |
| 6,125,257 A | | 9/2000 | Sekine et al. | 399/343 |
| 6,160,569 A | | 12/2000 | Fujimori et al. | 347/262 |
| 2002/0009311 A1 | * | 1/2002 | Katsuyama | |

FOREIGN PATENT DOCUMENTS

| | | | |
|---|---|---|---|
| EP | 1 030 227 | | 8/2000 |
| EP | 1 126 328 | | 8/2001 |
| JP | 03-269461 | | 12/1991 |
| JP | 10-161498 | | 6/1998 |
| JP | 11-119536 | | 4/1999 |
| JP | 2000-238843 | * | 9/2000 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

The container includes a container body that has a structure in which its walls constructing an interior space are collapsible and an aperture in one section of the body when constructed. Encasement is made up of a volume-reducible inflated body that can be accommodated inside the container body. This encasement encases a toner. Contents display sections that display information on the toner inside the encasement are provided on the encasement and the container body.

10 Claims, 4 Drawing Sheets

CONTAINER, ITS SUPPORT STRUCTURE, AND IMAGE FORMATION APPARATUS

FIELD OF THE INVENTION

The present invention relates to a container, its support structure and an image formation apparatus. More particularly, this invention relates to an identification structure for respective containers. The container is for example a cartridge that encase developer inside.

BACKGROUND OF THE INVENTION

Developing is carried out in image formation apparatuses such as copying machines, facsimile machines and printers that make use of electrophotographic copying. Toner is used as a developing material ("developer") in such developing. The toner is supplied to an electrostatic latent image formed on an image carrier such as a photoreceptor to make the image visible, i.e. develop the image.

The developing is performed in case of not only monochrome images but also color images such as full color images. When full color images are to be developed, a developing apparatus encases developers that are of complementary colors of the colors of the electrostatic latent image.

Naturally, the toner gets consumed during the developing. If there is insufficient toner, then in worst case, proper image cannot be formed. Conventionally, the developing apparatus in the image formation apparatus is a tank ("toner tank") containing the toner. Sometimes the developing apparatus may include another container that contains additional toner for supplying new toner to the toner tank when the toner in the toner tank is consumed. This additional container will be referred to as supply developer cartridge.

The supply developer cartridge has been conventionally constructed as having a cylindrical bottle structure or as a hard encasement. When supply developer cartridge becomes empty it is collected by a serviceman. These collected cartridges are stored until they are recycled or discarded. However, these supply developer cartridges occupy considerable space and a large space is required to store these cartridges. In order to maintain large space, there is a drawback, that the cost increase.

When plurality of cartridges including the supply developer cartridges containing color developers are used, information on the developers encased inside must be identified from the outside. Conventionally, a method has been known in which a seal or a bar code display member displaying the contents is attached on the exterior surface of the cartridge. However, in this method, there is a risk of not being able to identify the contents if the attached member is detached accidentally.

There has been another method in which an identification section is molded in the cartridge itself. In this method, recesses or protrusions are provided on a section of the exterior surface of the cartridge. Further, the recesses and the protrusions are formed into different shapes in such a manner that the contents can be identified by the fitting state of the section into fitting points provided on a position where the cartridge is to be loaded.

However, in this another method, the molding cost of the cartridge is high, and there is a possibility of increasing the cost of the cartridge itself. If information on destinations of the cartridges from the factory is added in addition to the identification of the contents, the number of the recesses or the protrusions must increase extraordinarily and there may be a problem of having to increase the size of the cartridge itself. In such a method in which compatibility and incompatibility between the cartridge side and the side to be loaded onto are involved, machining cost and cost of apparatuses using the machined cartridges increase, and downsizing of the apparatuses cannot be achieved.

SUMMARY OF THE INVENTION

It is an object of this invention to provide a container having a structure of which downsizing is possible without any increase in cost of management and machining, a support structure of the container, and an image formation apparatus in which the cartridges according to the present invention are mounted.

The container according to this invention comprises a container body having a collapsible structure formed with walls surrounding a hollow interior space, wherein when constructed said container has an aperture; and an encasement which encases a toner and which can be accommodated in the space in said container body, said encasement having a volume-reducible inflated body, said encasement having a seal aperture formed in a sealing section provided in a section of said encasement, wherein said seal aperture can be loaded in said aperture of said container body. The encasement is loaded inside said container body before said container body is constructed, and an encasement space is constructed inside as said seal aperture is loaded in said aperture of said container body.

Other objects and features of this invention will become apparent from the following description with reference to the accompanying drawings.

DESCRIPTION OF THE PREFERRED EMBODIMENTS

Embodiments of the present invention will be explained below while referring to the accompanying drawings.

Figure 1:
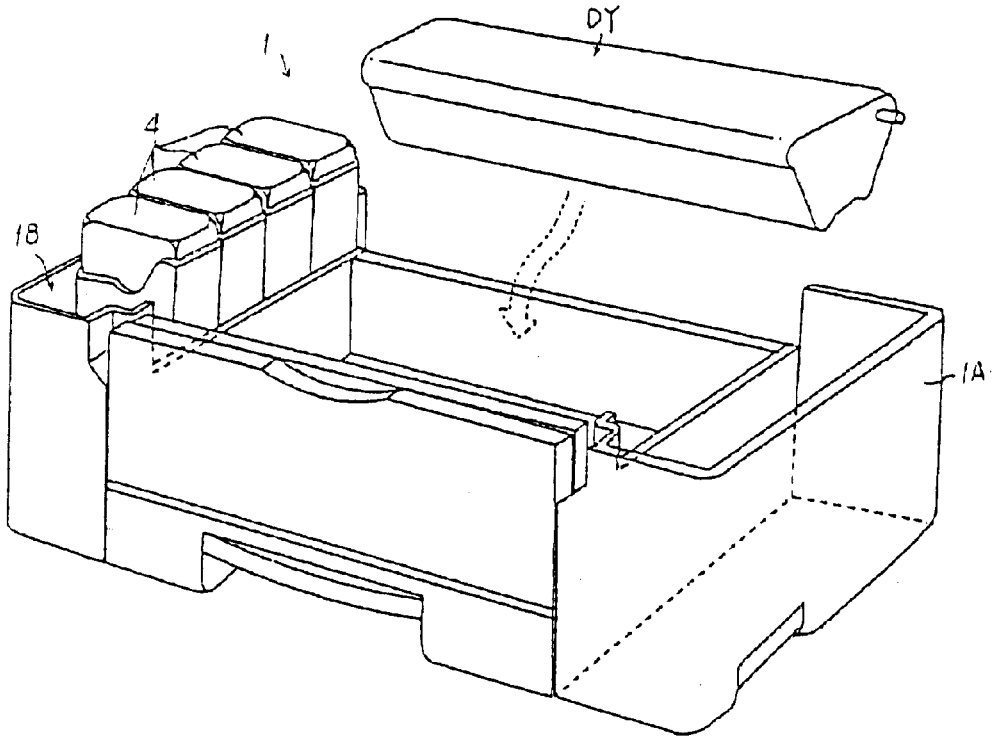
FIG. 1 illustrates an outside view of an image formation apparatus equipped with a container according to one embodiment of the present invention.

FIG. 1 shows an outside view of a container according to the present invention and an image formation apparatus using the container's support structure with a cover (not illustrated) of the apparatus' housing 1A removed. The image formation apparatus is a full-color printer 1, which uses developers having complementary colors of the electrostatic latent image. In the present invention, not only printers but also copying machines or facsimile machines belong to the category of the image formation apparatus.

Figure 2:
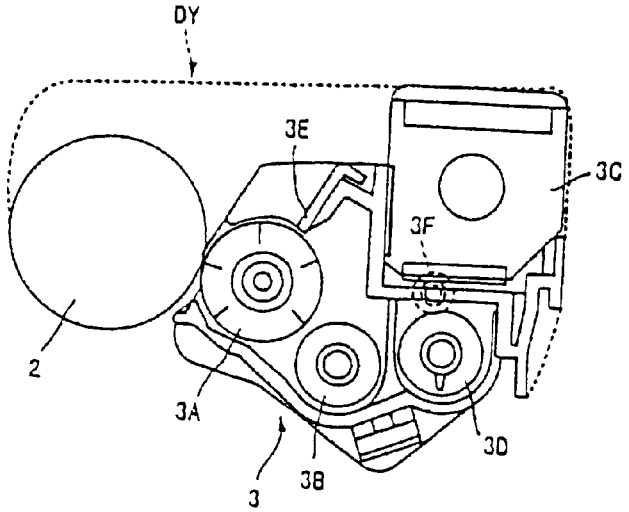
FIG. 2 shows one component of an image formation arrangement used in the image formation apparatus illustrated in FIG. 1.

As shown in FIG. 1, the full-color printer 1 has an image formation arrangement (not illustrated) inside. As shown in FIG. 2, as one component of the image formation arrangement, an image formation unit (referred to by a reference mark DY for convenience, indicating a development unit) constructed as a unit configuration consisting of a drum-shaped photoreceptor 2, which is a latent image carrier and a developing apparatus 3, is provided.

The full-color printer 1 shown in FIG. 1 comprises the image formation units DY illustrated in FIG. 2 respectively for each color. In each image formation unit DY, a visible image carried by the photoreceptor 2 in the respective image formation units is directly copied onto a recording sheet, the images superposed on the recording sheet in each image formation unit DY are fixed by a fixing device, and the sheet is ejected from the unit. By such direct copying against the recording sheet, intermediate copying bodies, which have been used in this kind of image formation apparatus, can be omitted to achieve downsizing of the apparatus.

The developing apparatus 3 shown in FIG. 2, which is equipped in the image formation unit DY, comprises, as its main parts: a development sleeve 3A which supplies the developer to the photoreceptor 2; a transport screw 3B which transports and agitates the developer contained inside; a lead-in screw 3D positioned below the developer outlet formed underneath a developer tank 3C; and a layer thickness restriction blade 3E carried on the development sleeve 3A. In the space where the lead-in screw 3D is placed, an aperture 3F, in which the developer, transported from the developer supply cartridge 4 composed of an after-mentioned container, inflows, is formed.

As shown in FIG. 1, the developer supply cartridges 4 which contain supplemental developer for the developing apparatus 3 are placed color by color along a cartridge loading section 1B provided in the housing 1A of the full-color printer 1.

Figure 3:
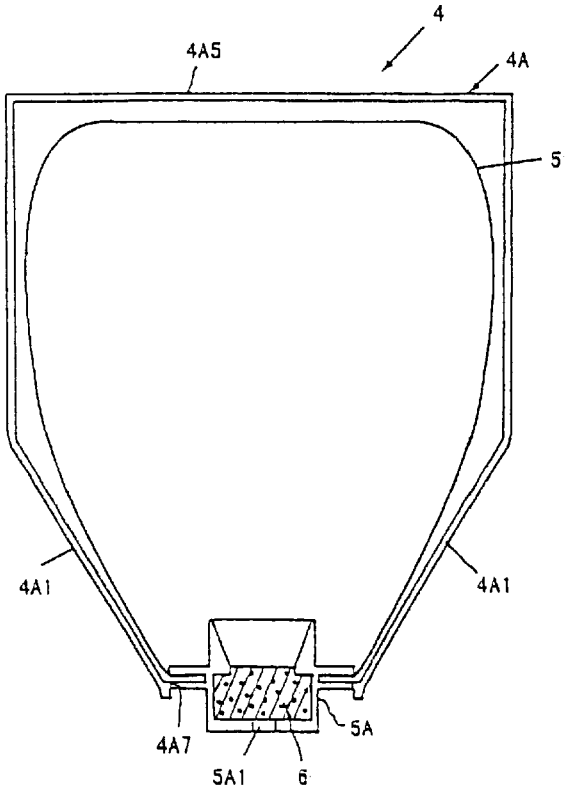
FIG. 3 shows a schematic diagram for describing an inside structure of a container according to another embodiment of the present invention.

FIG. 3 shows the internal structure of the developer supply cartridge 4 composing a container. The main parts of the developer supply cartridge 4 comprise a container body 4A and an encasement 5.

Figure 4:
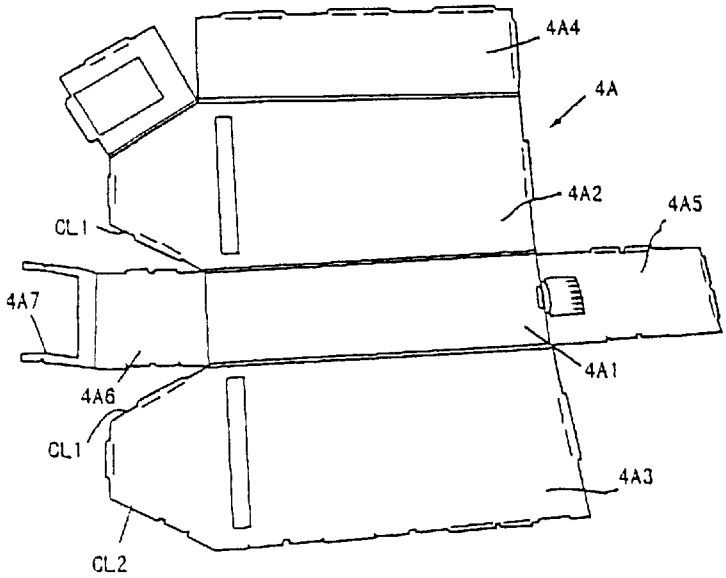
FIG. 4 shows an unfolded view of a container body used in the container shown in FIG. 3.

The container body 4A is a molded product made of polyethylene or polypropylene, which can be constructed into a box shape by folding it from its unfolded state shown in FIG. 4. The container body 4A is provided with 6 faces 4A1–4A6 hingedly connected to form each wall surface when constructed into a box shape.

In the container body 4A, the rims on one end of the longitudinal sides on the faces 4A2 and 4A3 opposing each other are formed as inclined sides CL1 and CL2. When the container body is folded from its unfolded state, its top is constructed into a truncated quadrangular pyramid shape.

An aperture 4A7, which is notched, is formed at the truncated-quadrangular-pyramid-shaped top. Further, a later-described seal aperture of the encasement 5 is to be fitted in the aperture 4A7.

Referring to FIG. 3, the encasement 5 has an inflated body made of polyethylene film of which its volume can be reduced. A cap 5A, which fits in the aperture 4A7 of the container body 4A, is combined in the aperture of the encasement 5.

In the cap 5A, an outlet 5A1 is formed for ejecting the developer that is in the encasement 5. A sealant 6 such as a sponge is filled in the outlet 5A1 to seal off the inside of the encasement 5. The sealant 6 is split apart by a sharp member sticking into it and can connect the outside and the inside together, and when connected, the developer encased inside can be ejected outside.

By being fitted in with the sealant 6, the outlet 5A1 composes the seal aperture that seals off the inside of the encasement 5 except when the sharp member sticks into the sealant 6 as described above.

Figure 5:
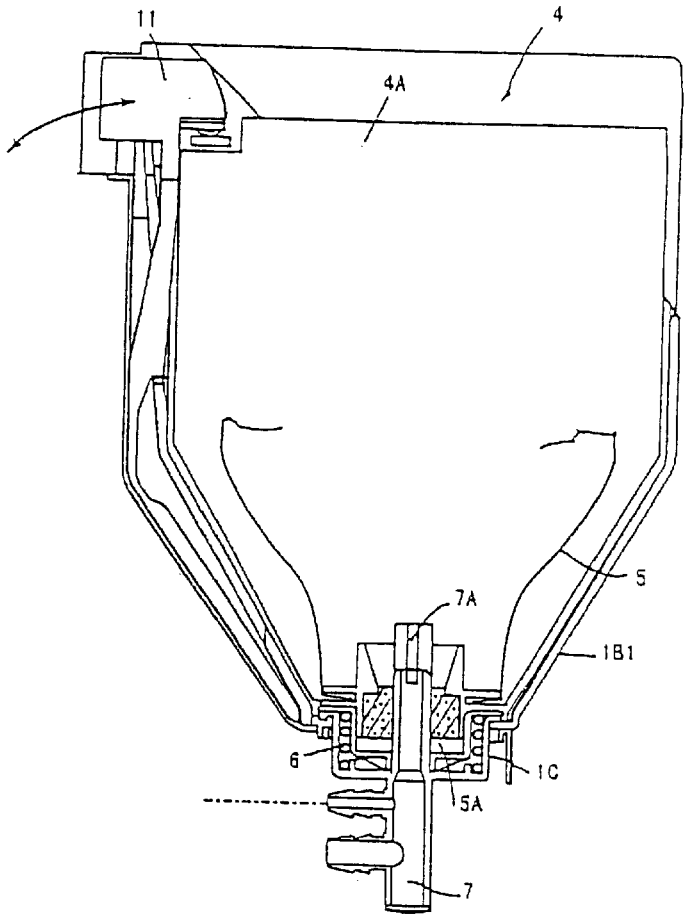
FIG. 5 shows a schematic diagram for describing a structure of a loading section of the container shown in FIG. 3.

The container 4 is loaded removably onto the loading section provided in the housing 1A of the full-color printer as shown in FIG. 5.

Referring to FIG. 5, the container 4 can be loaded by being dropped inside a cartridge holder 1B1, which is provided in the housing 1A and has an inner surface shaped according to the outer shape of the container body 4A.

The cartridge holder 1B1 is provided with a suction nozzle 7 (having a shape shown in FIG. 6) which is long enough for the nozzle to approach to the inside of the outlet 5A1 that is the seal aperture of the encasement 5. A hose (shown by a dashed line in FIG. 5) extended from a suction pump (not shown) is to be connected to the suction nozzle 7. Through suction by the suction pump, the developer inside the encasement 5 is aspirated and ejected outside, towards a tank 3C (shown in FIG. 2) of the developing apparatus 3 for this embodiment, from a suction aperture 7A (having a shape shown in FIG. 6) formed at the top of the nozzle.

Referring to FIG. 5, the position in which the suction nozzle 7 is placed, that is, the mounting section on which, the cap 5A of the encasement 5, revealed outside from the aperture 4A7 (see FIG. 3) of the container 4A, is to be mounted, is provided with a structure for aligning the central positions of the suction nozzle 7 and the outlet 5A1 composing the seal aperture.

Figure 6:
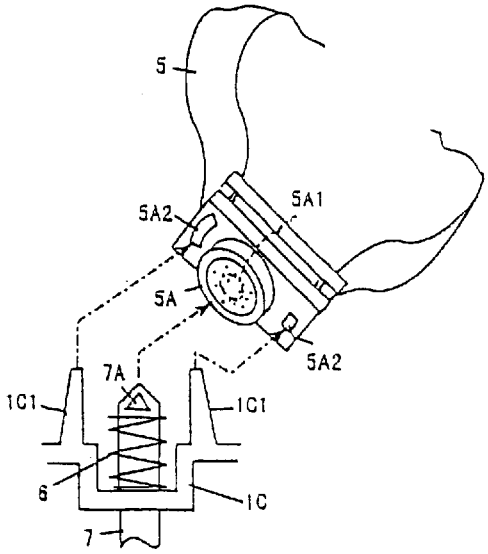
FIG. 6 shows a perspective view for describing a center positioning structure provided on the loading section and the container that are shown in FIG. 5.

FIG. 6 shows a schematic diagram of the mounting section 1C shown in FIG. 5, in a state viewed from the right-hand side of the drawing of FIG. 5, for describing the structure for aligning the central positions. A pair of nozzle-guide members 1C1 protruded upward from the bottom of the mounting section 1C are provided on the mounting section 1C in opposing positions on a horizontal plane around the center of the outlet 5A1 of the encasement 5. The nozzle-guide members 1C1 are to be inserted into fitting points 5A2 provided on the cap 5A. The nozzle-guide members 1C1 are also to be removably placed, or fixed in a predetermined condition, on the mounting section 1C. The predetermined condition in this case means the condition corresponding to the later-mentioned forms of the fitting points 5A2.

Figure 7A:
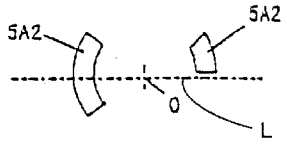
FIG. 7A to FIG. 7D describe forms of fitting points provided on a cap equipped on an encasement mounted in the container shown in FIG. 3.

The fitting points 5A2 are constructed as through holes through which the nozzle-guide members 1C1 can be inserted. The holes are formed in such a way that the forms of the holes opposing each other around the outlet 5A1 that is the seal aperture are different from one another. As shown in FIG. 7A, the forms of the fitting points are formed in such a way that the length of one of the fitting points on a horizontal plane around the center (the position shown by a circle mark in FIG. 7A to FIG. 7D) of the cap 5A can be longer than the other. Whether one of the fitting points is longer than the other hole, one of the holes may be placed biased to one side (see FIG. 7A) in reference to one of the center lines (the line shown by an L mark in FIG. 7A to FIG. 7D) of the cap 5A; the holes may be parted evenly (see FIG.

Figure 7B:
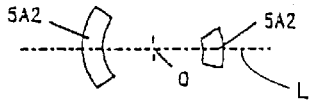
Figure 7C:
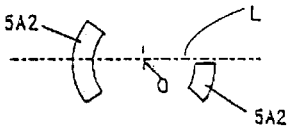
Figure 7D:
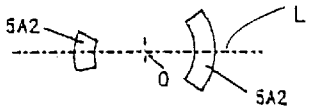

7B) along the center line L; the shorter fitting hole 5A2 according to the case shown in FIG. 7A may be placed biased toward a side (see FIG. 7C) opposite to the side shown in FIG. 7A; or the longer and shorter holes according to the case shown in FIG. 7B may be in positions (see FIG. 7D) opposite to their positions shown in FIG. 7B. The forms of the nozzle-guide members 1C1 provided on the mounting section 1C may be differed from one another in such a way that they correspond to the forms of the fitting points 5A2.

The fitting points 5A2 have a function that indicates as information the characteristics of the developer encased inside the encasement 5 by having different forms and the same function is to be delivered by the wall of the container body 4A.

Figure 8:
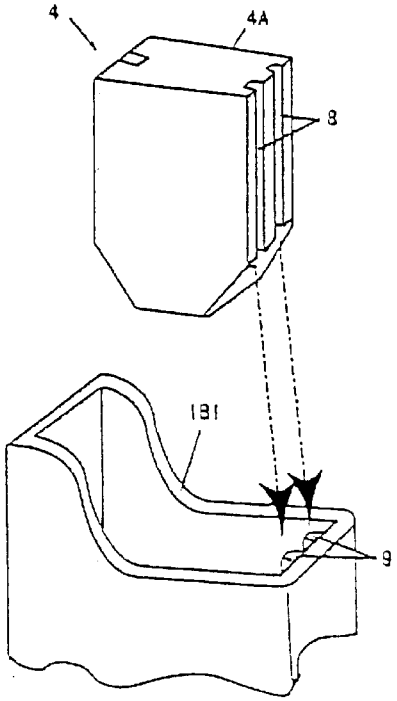
FIG. 8 shows a partial perspective view for describing concave grooves formed on the container body composing the container shown in FIG. 3 and the corresponding structure of the loading section.

FIG. 8 shows the opposed relationship between the cartridge holder lB and the developer supply cartridge 4 for describing their support structure. On a part of one of the walls of the developer supply cartridge 4, there are concave grooves 8 formed. On the interior surface of the cartridge holder 1B1 opposing the concave grooves, there are convex parts 9 formed.

The fitting points 5A2 and the concave grooves 8 are the sections that indicate information on color, particle size and the like which is one of the characteristics of the developer inside the encasement 5. The lengths of the holes and grooves and the positions in which they are to be formed can be varied.

The positions and the lengths of the convex parts 9 which are provided on the cartridge holder 1B1 side in such a way that the parts correspond to the positions of the concave grooves 8, may be changed. Although details are not illustrated in the drawings for this embodiment, fastening positions of the convex parts 9 onto the cartridge holder 1B1 can be varied. In other words, the parts may be fastened respectively onto different longitudinal positions and at different intervals in such a manner that they correspond to the forms of the concave grooves 8 provided on the developer supply cartridge 4 side. Instead of the above structure, the convex parts 9 may be positioned in desired positions by pasting or sticking and the deliver-to information and the like of the developer supply cartridge 4 can be added in addition to the information on the above-mentioned characteristic of the developer itself. The convex parts serve as a compatible section corresponding to the concave grooves 8 and the nozzle-guides 1C1 to be engaged into the fitting points 5A2 serve as a compatible section corresponding to the fitting points 5A2. Thus in this embodiment, the convex parts 9 and the nozzle-guides 1C1 represent the first and the second compatible sections respectively.

As shown in FIG. 5, an elastic body 10 such as a spring for urging the cap 5A of encasement 5 upward inside the mounting section 1C is placed in the cartridge holder 1B1. The raising of the container 4 can be restricted because of the urge placed by the elastic body 10, with the top section of the container body 4A being pressured by the flexible support arm 11 rockable in the direction of the arrow with an oscillation fulcrum on the sidewall of the cartridge holder 1B1.

Due to the above structure in this embodiment, information on the characteristics, deliver-to information or specifications of the developer encased in the developer supply cartridge 4 is indicated by the fitting points 5A2 and the concave grooves 8 beforehand. According to the sizes, lengths and positions of the fitting points 5A2 and the concave grooves 8, formed respectively on the cap 5A and a section of the wall of the container body 4A, the forms of the nozzle-guides 1C1 and the convex parts 9 on the cartridge holder 1B side can be decided.

When the container 4 is folded into a box shape from the unfolded state shown in FIG. 4, the aperture 5A of the encasement 5 is mounted on the notched aperture 4A7 provided on the container body 4A.

The container 4 can be loaded on the cartridge holder 1B only when the forms of the convex parts 9 representing the first compatible section and the concave grooves 8 match with each other and the forms of the fitting points 5A2 and the nozzle-guides 1C1 match with each other, as the container 4 made into a box shape is dropped into the loading section 1C. Because the loading is not possible when the forms are mutually different, it can be immediately recognized during loading if the characteristics of the developer encased in the encasement 5 are different from those of the cartridge holder 1B in which the container 4 is to be loaded. As a result, a container 4 encasing the developer having different characteristics to those of the container 4 to be loaded in the cartridge holder 1B will not be falsely loaded, and color mixture, which occurs when a developer different to the developer having the desired color is loaded, can be unfailingly prevented.

Moreover, since the structures for determining the compatibility and incompatibility during the loading are provided separately on the container body 4 and the cap 5B equipped on the encasement 5, the size of the container body 4 does not have to be made larger in contrast to the case in which the structures are to be provided in the container body 4 only. When the characteristics of the developer inside the encasement 5 are newly changed, the forms of the nozzle-guides 1C1 and the convex parts 9 may be changed in conjunction with the changes in the fitting points 5A2 and concave grooves 8 on the cap 5A side and container body 4A. Because in this case, only the location or the fitting length against the concave grooves 8 are to be changed for the convex parts 9, preparation of another cartridge holder with a new structure is not required. Therefore, increase in the cost of equipment can be suppressed.

As the developer inside the encasement 5 is consumed, the negative pressure arising from the suction of the developer reduces the volume of the encasement 5, and when the developer is nearly completely consumed, the encasement 5 is deflated without maintaining its original form.

When the developer inside the encasement 5 is used up, the serviceman collects the container 4, which is to be in the unfolded state for the collection. As the volume at the beginning of developer supply is no longer maintained by the time of collection, space needed for the collection can be significantly reduced. In particular, because the containers are in their unfolded state, the already collected container bodies 4A can be stacked on top of one another. As a result, the space required in the collection is only for the area occupied by the unfolded body. Therefore the cost on the space required for management can be decreased.

According to the present invention, a center matching mechanism for matching the center positions of the outlet 5A1 comprising the seal aperture in the cap 5A of the encasement 5, and the suction nozzle 7, is combined with the structure for identifying the characteristic information of the developer inside the encasement 5. Therefore, the configuration can be simplified because it is not required to provide a special structure for identifying the information additionally, and different functions can be delivered with a single member.

In the above embodiment, the fitting points 5A2 are provided as through-holes in which nozzle guides 1C1 can be inserted, however, since the nozzle-guides 1C1 are protruded, the fitting points 5A2 may be formed as recesses into which the tips of the guides can be fitted in. This structure enables firm loading of the container 4 because the loading area is increased. In addition, the container body 4A does not have to have its top section shaped into a truncated quadrangular pyramid as shown in the above embodiment, and may be made into a cylindrical shape with its top section shaped into a truncated cone.

According to this invention, as explained above, the container body is collapsible and can compose the space into which the encasement can be mounted during the construction. Thus, this achieves decrease in space needed for the collection as the space occupied by the container bodies at the time of collection can be reduced. Furthermore, because the encasement that can be loaded with an item may be placed inside the container body, the interior surface of the container body will not be defaced and thus recycling may be encouraged, as reformation process in the recycling will not be required.

Furthermore, because the concave grooves provided on the container body side and the fitting points provided on the seal aperture of the encasement respectively have various forms, identification information can be provided on both the container body and the encasement and much information can thus be indicated. Moreover, since the information is not only provided on the container body but also on the encasement, the container body can be downsized more in contrast to the case in which all the information is to be provided on the container body.

Moreover, because the first and second compatible sections are provided, which are engageable with the concave grooves and the fitting points respectively provided on the container body and the encasement, the information on the item inside the container body can be recognized by the mismatching or the matching of the forms of the compatible sections with those of the concave grooves and the fitting points. Therefore, false loading can be prevented from occurring.

In addition, because information for each color can be respectively identified when plurality of different colored developers are used, the container bodies to be loaded can be arranged accurately. Thus, problems such as color mixture can be solved and color images of high reproducibility can be obtained.

The present document incorporates by reference the entire contents of Japanese priority document, 2000-263387 filed in Japan on Aug. 31, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A container comprising:

a container body having a collapsible structure formed with walls surrounding a hollow interior space, wherein when constructed, said container has an aperture;

an encasement which encases a toner and which can be accommodated in the space in said container body, said encasement having a volume-reducible inflated body and having a seal aperture formed in a sealing section provided in a section of said encasement, wherein said seal aperture can be loaded in said aperture of said container body; and a cap which fits into the aperture of the container, said cap having fitting points different in form from one another, wherein:

said encasement is loaded inside said container body before said container body is constructed, and an encasement space is constructed inside as said seal aperture is loaded in said aperture of said container body, and when the container is loaded onto a mounting section having nozzle guide members extending therefrom, the nozzle guide members are inserted into the fitting points such that said container is aligned with said mounting section.

2. The container according to claim 1, further including contents display sections, which display information on an item encased inside said encasement, and placed on said container respectively in such a manner that it is relatively engageable and disengageable between said container body and a loading section on which said container body is to be loaded and between said seal aperture of said encasement and members for positioning said aperture onto said aperture of said container body.

3. The container according to claim 2, which comprises as said contents display sections, concave grooves provided on one section of a face comprising one of said walls of said container body and said fitting points having forms that are different from each other on said seal aperture of said encasement opposite to each other around the center of the aperture.

4. The container according to claim 3, wherein said concave grooves are provided in different forms corresponding to said information to be displayed.

5. The container according to claim 3, wherein said fitting points provided on said seal aperture are constructed as through holes.

6. The container according to claim 3, wherein display forms of said concave grooves and said fitting points provided on said container body and encasement respectively can be formed into different forms corresponding to contents of items inside said encasement.

7. A support structure of a container, said container having a container body having a collapsible structure formed with walls surrounding a hollow interior space, wherein when constructed, said container has an aperture;

an encasement which encases a toner and which can be accommodated in the space in said container body, said encasement having a volume-reducible inflated body and having a seal aperture formed in a sealing section provided in a section of said encasement, wherein said seal aperture can be loaded in said aperture of said container body; and a cap which fits into the aperture of the container, said cap having fitting points different in form from one another, wherein:

said encasement is loaded inside said container body before said container body is constructed, and an encasement space is constructed inside as said seal aperture is loaded in said aperture of said container body, and when the container is loaded onto a mounting section having nozzle guide members extending therefrom, the nozzle guide members are configured to insert into the fitting points such that said container is aligned with said mounting section, said support structure comprising:

a receiver provided in a position where said container body is to be loaded;

a first compatible section in said receiver, which can be engaged with said concave grooves on said container body; and a second compatible section in said receiver, which can be fitted into said fitting points provided on said seal aperture of said encasement, wherein said container can be received into said receiver when matching between said forms of said compatible sections match with concave grooves and said fitting points.

8. An image formation apparatus using a container, said container having a container body having a collapsible structure formed with walls surrounding a hollow interior space, wherein when constructed, said container has an aperture;

an encasement which encases a toner and which can be accommodated in the space in said container body, said encasement having a volume-reducible inflated body and having a seal aperture formed in a sealing section provided in a section of said encasement, wherein said seal aperture can be loaded in said aperture of said container body; and a cap which fits into the aperture of the container, said cap having fitting points different in form from one another, wherein:

said encasement is loaded inside said container body before said container body is constructed, and an encasement space is constructed inside as said seal aperture is loaded in said aperture of said container body, and when the container is loaded onto a mounting section having nozzle guide members extending therefrom, the nozzle guide members are configured to insert into the fitting points such that said container is aligned with said mounting section, and said encasement encasing a developer of a different color is sealed inside said container body.

9. The image formation apparatus according to claim 8, further comprising a plurality of developers of different colors.

10. The image formation apparatus according to claim 8, wherein at least the color of said developer encased inside said encasement can be identified by said container, from concave grooves of said container body and fitting points of said encasement.

* * * * *